US006045344A

United States Patent [19]

Tsuboi et al.

[11] Patent Number: 6,045,344

[45] Date of Patent: Apr. 4, 2000

[54] OIL-COOLED TYPE SCREW COMPRESSOR

[75] Inventors: Noboru Tsuboi; Katsuyuki Suzuki, both of Hyogo; Hideo Utsuno; Yoshitaka Morisawa, both of Kobe, all of Japan

[73] Assignees: Kabushiki Kaisha Kobe Seiko Sho; Kobelco Research Institute, Inc., both of Kobe, Japan

[21] Appl. No.: 09/129,901

[22] Filed: Aug. 6, 1998

[30] Foreign Application Priority Data

Aug. 11, 1997 [JP] Japan ..... 9-216276

[51] Int. Cl.[7] ..... F04C 2/00; F04C 15/00

[52] U.S. Cl. ..... 418/100; 418/201.1; 418/DIG. 1

[58] Field of Search ..... 418/DIG. 1, 201.1, 418/100

[56] References Cited

FOREIGN PATENT DOCUMENTS

| | | | |
|---|---|---|---|
| 4202155 | 9/1992 | Germany | 418/DIG. 1 |
| 191690 | 8/1987 | Japan | 418/DIG. 1 |
| 404112993 | 4/1992 | Japan | 418/DIG. 1 |
| 404187890 | 7/1992 | Japan | 418/DIG. 1 |
| 404301194 | 10/1992 | Japan | 418/DIG. 1 |

*Primary Examiner*—Thomas Denion
*Assistant Examiner*—Theresa Trieu
*Attorney, Agent, or Firm*—Oblon, Spivak, McClelland, Maier & Neustadt, P.C.

[57] ABSTRACT

An oil-cooled type screw compressor capable of improving the oil separating efficiency is provided. The oil-cooled type screw compressor includes an outer casing 21 which encloses at least a bearing portion on a discharge port 12 side of a compressor body 1 in an isolated state from a suction port 11, an oil separating element 22 which comprises an inside portion 22A and an outside portion 22B partitioned from each other by an annular partition plate 26 and which bisects the inside space of the outer casing into a space 27 on the compressor body side and a space 28 on the side opposite to the compressor body, a first discharge pipe 23 which conducts a compressed gas discharged together with oil from the discharge port 12 to the inside portion 22A, a shielding plate 24 for isolating the inside portion 22A from the compressor body-side space 27, and a second discharge pipe 25 extending through both the oil separating element 22 and the portion of the casing 21 which covers the space 28 on the side opposite to the compressor body, to conduct the compressed gas which has entered the compressor body-side space 27 from the opposite-side space 28 to the exterior.

4 Claims, 1 Drawing Sheet

OIL-COOLED TYPE SCREW COMPRESSOR

BACKGROUND OF THE INVENTION

1. Field of the Invention

The present invention relates to an oil-cooled type screw compressor in which at least a discharge port-side portion of a compressor body is positioned within a casing with an oil separating element received therein.

2. Description of the Prior Art

Heretofore, such an oil-cooled type screw compressor as shown in FIG. 2 has publicly been known. In this known compressor, a motor 42 as drive means for screw rotors 41 has a shaft 43 in common with one screw rotor 41, and a body casing 44 which houses the screw rotors 41 therein and a motor casing 45 of the motor 42 are formed integrally with each other (Japanese Patent Laid Open No. 184984/85). In FIG. 2, gas is sucked in through a suction port 46 formed in the left end face of the motor casing 45, then passes through a clearance formed between a stator and a rotor of the motor 42, then is compressed by the screw rotors 41 while being oiled, and passes through an oil separating element 47 for the separation of oil from the gas. The thus-compressed gas is discharged from a discharge port 48 formed in a right upper position of the casing 44 in FIG. 2. On the other hand, the oil separated from the compressed gas by the oil separating element 47 is once stored in an oil sump 49.

In the above known compressor, the oil discharged together with the compressed gas from the screw rotors 41 is captured by the oil separating element 47 and gradually stays in the same element, as indicated with cross hatching in FIG. 2. As a result, the portion of the oil separating element 47 through which the compressed gas can pass becomes narrower gradually, thus giving rise to the problem that the oil separating efficiency is deteriorated.

SUMMARY OF THE INVENTION

The present invention has been accomplished for eliminating the above-mentioned problem of the prior art and it is an object of the invention to provide an oil-cooled type screw compressor capable of improving the oil separating efficiency.

More specifically, according to the present invention, in order to solve the foregoing problem of the prior art, there is provided an oil-cooled type screw compressor comprising: a compressor body; an outer casing which encloses at least a discharge port-side bearing portion of the compressor body in an isolated state from a suction port; an oil separating element which bisects the inside space of the outer casing into a space on the side of the compressor body and a space on the side opposite to the compressor body; a partition plate for partitioning the oil separating element into two portions; a first discharge pipe for conducting a compressed gas discharged together with oil from a discharge port of the compressor body to one of the portions of the oil separating element partitioned by the partition plate; a shielding plate for isolating the one portion of the oil separating element from the compressor body-side space; and a second discharge pipe extending through both the oil separating element and the portion of the outer casing which portion covers the space on the side opposite to the compressor body, to conduct the compressed gas which has entered the compressor body-side space from the opposite-side space further to the exterior.

According to this construction, the gas which has flowed, together with oil, from the first discharge pipe into the opposite-side space through the one portion of the oil separating element partitioned by the partition plate then passes through the other portion of the oil separating element partitioned by the partition plate, whereby the oil separating efficiency is improved.

According to the present invention, moreover, the partition plate is annular to bisect the oil separating element into an inside portion and an outside portion. Further, the one portion of the oil separating element through which portion the first discharge pipe conducts the compressed gas corresponds to the said inside portion.

With this construction, the first discharge pipe, the partition plate, the shielding plate and the second discharge pipe can be arranged efficiently within the inside space of the outer casing.

Moreover, according to the present invention, the first discharge pipe is constituted so as to exhibit the function of a throttle pipe.

With this construction, by once throttling the discharged compressed gas by the first discharge pipe and then allowing it to spread at a stretch in the oil separating element, it becomes possible to reduce the discharge noise.

DETAILED DESCRIPTION OF A PREFERRED EMBODIMENT

An embodiment of the present invention will be described in detail hereinunder with reference to the accompanying drawings.

Figure 1:
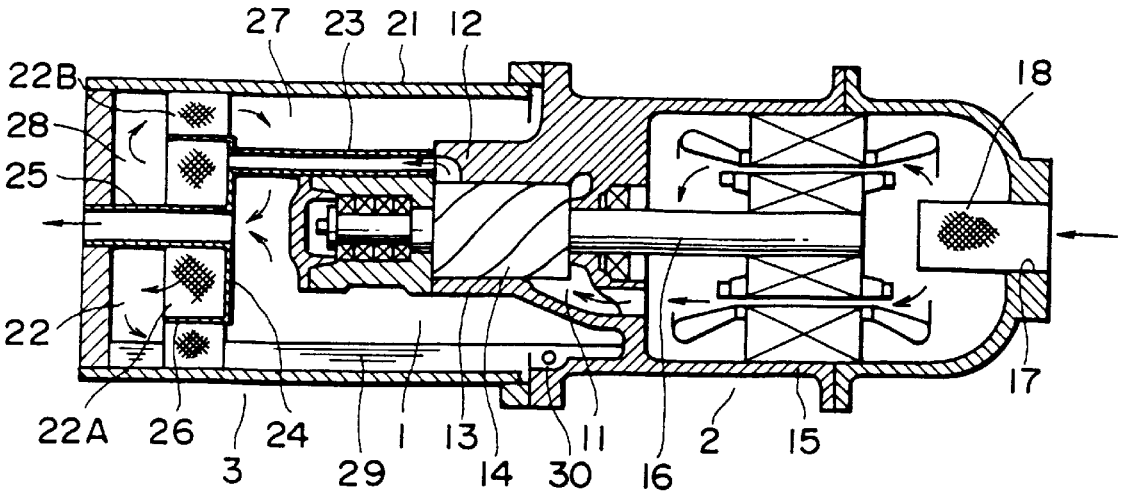
FIG. 1 is a sectional view of an oil-cooled screw compressor embodying the present invention.
Figure 2:
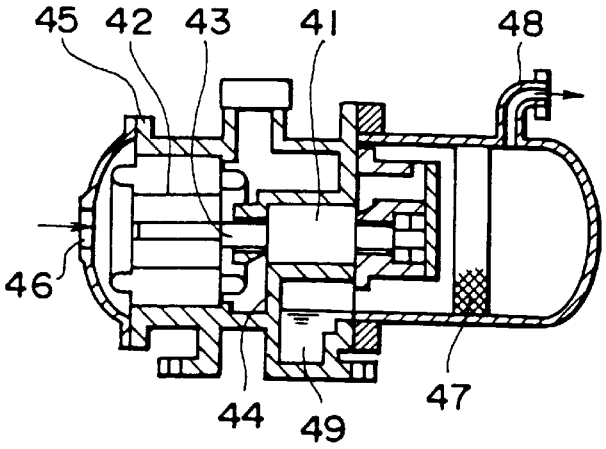
FIG. 2 is a sectional view of a conventional oil-cooled type screw compressor.

FIG. 1 illustrates an oil-cooled type screw compressor embodying the present invention, which compressor comprises a compressor body 1, a motor 2 and an oil separating/recovering section 3.

The compressor body 1 is of a well-known structure in which a body casing 13 is formed with a suction port 11 on one side and a discharge port 12 on the other side, and a pair of male and female screw rotors 14 (only one is shown in the figure) meshing with each other are accommodated rotatably within the body casing 13.

The motor 2 has a motor casing 15 integral with the body casing 13, and an output shaft 16 thereof also serves as a rotor shaft of one screw rotor 14 to drive the screw rotor. A through hole 17 for the suction of gas is formed in the end face of the motor casing 15 on the side opposite to the compressor body, and a suction filter 18 is fitted in the through hole 17. Gas which has passed through the suction filter 18 and entered the motor casing 15 further passes through a stator-rotor clearance of the motor 2 and reaches the suction port 11.

The oil separating/recovering section 3 comprises an outer casing 21, an oil separating element 22, a first discharge pipe 23, a shielding plate 24, and a second discharge pipe 25. The outer casing 21 encloses the body casing 13 of the compressor body 1, including the discharge port 12, in an isolated state from the suction port 11. The oil separating element 22 comprises an inside portion 22A and an outside portion 22B which are partitioned from each other with an annular partition plate 26. The oil separating element 22 bisects the inside space of the outer casing 21 into a space 27 on the compressor body side and a space 28 on the side opposite to the compressor body. The first discharge pipe 23 exhibits the function of a throttle pipe having a small flow path section and conducts the compressed gas discharged, together with oil, from the discharge port 12 of the compressor body 1 to the inside portion 22A. The shielding plate 24 isolates the inside portion 22A from the compressor body-side space 27. The second discharge pipe 25 extends through the oil separating element 22 and further through the portion (the portion on the left-hand side of the oil separating element in FIG. 1) of the outer casing 21 which portion covers the space 28 formed on the side opposite to the compressor body, to conduct the compressed gas which has flowed from the opposite-side space 28 into the compressor body-side space 27 through the outside portion 22B.

The lower portion of the outer casing 21 serves as an oil sump 29. The oil staying in the oil sump 29 is discharged from an oil discharge port 30, then the oil is fed to portions to be oiled in the compressor body 1 such as a bearing and axial seal portion and a rotor chamber. Thereafter, the oil is again recycled into the oil sump 29.

In the compressor constructed as above, the gas which has been sucked in from the suction port 11 is compressed while being supplied with oil from the oil sump 29 and is discharged, together with the oil, from the discharge port 12 into the first discharge pipe 23 which functions as a throttle pipe. The compressed gas and oil which have passed through the first discharge pipe 23 reach the inside portion 22A of the oil separating element 22 and spreads at a stretch, whereby the discharge noise is reduced. First, oil is captured in the inside portion 22A. The remaining oil which is not captured in the inside portion 22A and the compressed gas enter the outside portion 22B through the space 28 on the side opposite to the compressor body. In this process the oil is separated again from the compressed gas.

In this way the compressed gas together with oil is conducted to the outside portion 22B as an area different and isolated from the inside portion 22A of the oil separating element 22, where the oil is again separated. By so doing, the separation of oil is performed uniformly without being localized in part of the oil separating element 22 and thus it is possible to farther improve the oil separating efficiency.

The clean compressed gas after oil separation in the outside portion 22B then enters the space 27 formed on the compressor body side and is thereafter fed to the exterior of the compressor through the second discharge pipe 25.

Although in the compressor of the above construction the body casing 13 encloses the compressor body 1, including the discharge port 12, any special limitation is placed thereon insofar as the body casing 13 encloses the bearing portion on the discharge port 12 side of the compressor body 1.

As set forth hereinabove, the oil-cooled type screw compressor of the present invention comprises an outer casing which encloses at least a discharge port-side bearing portion of the compressor body in an isolated state from a suction port; an oil separating element which comprises an inside portion and an outside portion partitioned from each other by an annular partition plate and which bisects the inside space of the outer casing into a space on the side of the compressor body and a space on the side opposite to the compressor body; a first discharge pipe for conducting a compressed gas discharged together with oil from a discharge port of the compressor body to the inside portion of the oil separating element; a shielding plate for isolating the inside portion of the oil separating element from the compressor body-side space; and a second discharge pipe extending through both the oil separating element and the portion of the outer casing which portion covers the space on the side opposite to the compressor body, to conduct the compressed gas which has entered the compressor body-side space from the opposite-side space further to the exterior.

According to this construction, the compressed gas which has flowed, together with oil, into the inside portion of the oil separating element through the first discharge pipe passes through the outside portion of the oil separating element which is divided from the inside portion, thus bringing about the effect that the oil separating efficiency is improved. Further, by once throttling the discharged gas through the first discharge pipe and then allowing it to spread at a stretch, it is made possible to reduce the discharge noise.

What is claimed is:

1. An oil-cooled type screw compressor comprising:

a compressor body;

an outer casing which encloses at least a discharge port-side bearing portion of said compressor body in an isolated state from a suction port;

an oil separating element which bisects the inside space of said outer casing into a space on the side of said compressor body and a space on the side opposite to the compressor body;

a partition plate for partitioning said oil separating element into two portions;

a first discharge pipe for conducting a compressed gas discharged together with oil from a discharge port of the compressor body to one of said oil separating element partitioned by said partition plate;

a shielding plate for isolating said one portion of the oil separating element from the compressor body-side space; and a second discharge pipe extending through both said oil separating element and the portion of said outer casing which portion covers the space on the side opposite to the compressor body, to conduct the compressed gas which has entered the compressor body-side space from the opposite-side space further to the exterior.

2. An oil-cooled type screw compressor according to claim 1, wherein said partition plate is annular and bisects said oil separating element into an inside portion and an outside portion.

3. An oil-cooled type screw compressor according to claim 2, wherein said one portion of said oil separating element to which said first discharge pipe conducts the compressed gas is said inside portion.

4. An oil-cooled type screw compressor according to claim 1, wherein said first discharge pipe is a throttle pipe.

* * * * *